United States Patent [19]

Sanchez

[11] 4,277,104

[45] Jul. 7, 1981

[54] RECIPROCATING SHINGLE REMOVER WITH UPWARD THRUST BLADE

[76] Inventor: Edward J. Sanchez, 727 Richland Ave., Baton Rouge, La. 70806

[21] Appl. No.: 111,054

[22] Filed: Jan. 10, 1980

Related U.S. Application Data

[63] Continuation-in-part of Ser. No. 953,411, Oct. 23, 1978.

[51] Int. Cl.[3] ..... E04D 15/00

[52] U.S. Cl. ..... 299/37; 15/93 R; 30/169

[58] Field of Search ..... 299/37; 15/93 R; 30/169, 170

[56] References Cited

U.S. PATENT DOCUMENTS

| | | | |
|---|---|---|---|
| 1,242,479 | 10/1917 | Russell | 15/93 R |
| 1,979,554 | 11/1934 | Huntington | 299/37 |
| 2,722,072 | 11/1955 | Aspeek | 30/169 |
| 3,195,232 | 7/1965 | Toth | 30/169 |
| 3,542,433 | 11/1970 | Probst | 299/37 |
| 3,726,565 | 4/1973 | Oliverius | 299/37 |

*Primary Examiner*—Ernest R. Purser

*Attorney, Agent, or Firm*—Roy, Kiesel, Patterson & McKay

[57] ABSTRACT

A power driven device for removing shingles from roof surfaces is disclosed having a reciprocating plate with a notched forward edge that moves in a concave arc during the reciprocating movement.

2 Claims, 3 Drawing Figures

RECIPROCATING SHINGLE REMOVER WITH UPWARD THRUST BLADE

RELATED APPLICATIONS

This is a continuation-in-part of U.S. patent application Ser. No. 953,411, filed Oct. 23, 1978, by the inventor herein, and entitled "Composition Roof Shingle Remover", which parent case has been allowed.

BACKGROUND OF THE INVENTION

1. Field of the Invention

This invention relates broadly to power driven devices, more particularly, power driven devices for removal of roof shingles from building structures.

2. Prior Art

Most residential homes and some commerical buildings employ asphalt roof shingles on their roofs. As these shingles wear out, they must be removed and replaced in order to avoid water leakage into the buildings. The problem of how to remove effectively and efficiently these old shingles has been studied by the housing industry for some time. Examples of various earlier machines developed for this purpose can be seen in Perelman U.S. Pat. No. 1,415,949, issued May 16, 1922, and entitled "Roof Scraping Machine", and in Libertini U.S. Pat. No. 1,949,482, issued Nov. 6, 1932, and entitled "Scraping Machine". However, for various reasons, prior attempts to develop an efficient and method device have not been successful. Therefore, applicant herein devised a shingle remover disclosed in the parent case identified above, which was capable of rapidly removing old shingles. However, in view of a need to further improve the effectiveness and efficiency of the removal without damage to the tar paper generally located between the roof shingles and the plyboard forming the roof, applicant has invented the shingle removing device disclosed herein.

SUMMARY OF THE INVENTION

Therefore, one object of this invention is to provide a device which can easily and quickly remove roof shingles from building roofs.

Another object of this invention is to provide a power driven device which can remove roof shingles from building roofs.

Still another object of this invention is to provide a power driven device which can effectively and efficiently remove roof shingles from building roofs without destruction of the tar paper located between the building shingles and the plywood base which forms part of the roof.

Other objects and advantages of this invention will become apparent from the ensuing descriptions of the invention.

Accordingly, a power driven device for removing roof shingles from a roof is provided having a power source mounted on a frame assembly, a metal plate having a notched edge positioned forward of the assembly, and a drive means attached to the power source and the plate to reciprocately move the notched edge forward and backward in a channel assembly for forcing the notched edge to move in a concave arc path.

PREFERRED EMBODIMENTS OF THE INVENTION

Figure 1:
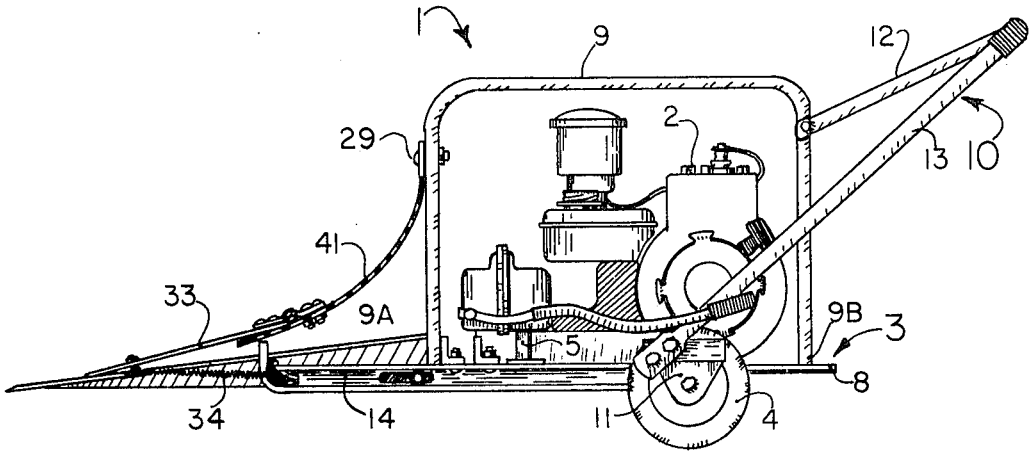
FIG. 1 is a three dimensional side view of one preferred embodiment of the invention.

As seen in FIG. 1, a roof shingle remover, denoted generally by the numeral 1, is depicted comprising a motor 2 mounted on frame 3, having rear wheels 4 rotatably attached thereto. Motor 2 comprises a vertical drive shaft 5 which attaches at its lower end to a reciprocating drive means assembly 6 (see FIG. 3) that attaches to shingle remover plate 7 to reciprocately move plate 7. Plate 7 is provided with notched edge having finger members 7A which, as explained below, get underneath the roof shingles and lift them off of the roof. In a preferred embodiment, frame 3 comprises a base plate 8 to which is fixedly mounted motor 2, lifting bar 9 extending over motor 2 and attached at either end 9A and 9B to base plate 8, handle 10 for pushing roof shingle remover 1 and attached to lifting bar 9 and both wheel shaft shoulder plate 11 by metal rods 12 and 13, respectively. Welded to base plate 8 are metal side skirts 14 that extend in front of motor 2 and are perpendicularly attached to the edges of base plate 8 as shown in FIGS. 1 and 3.

Figure 3:
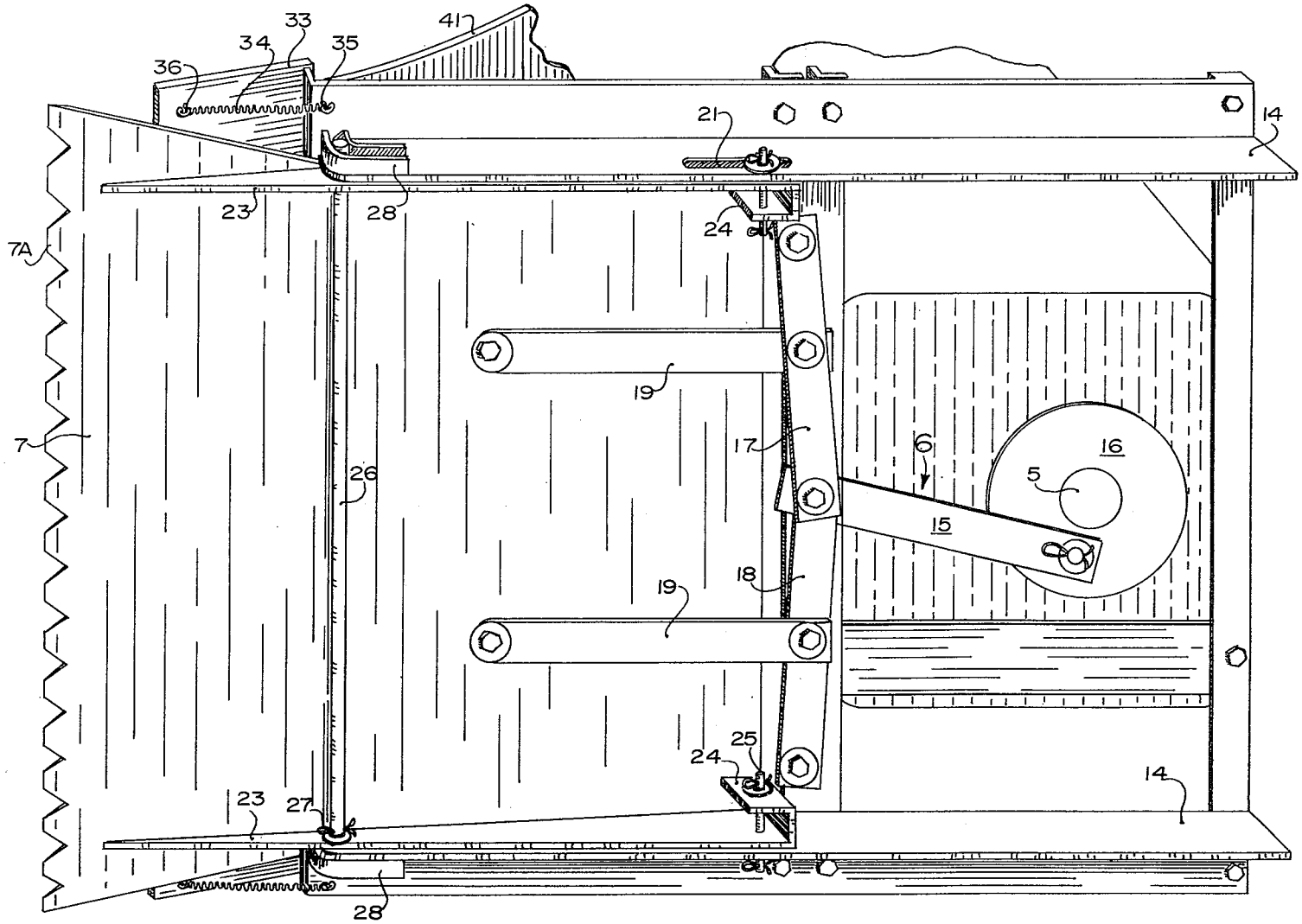
FIG. 3 is a three dimensional bottom view of a preferred embodiment of this invention.

Turning to FIG. 3, drive means assembly 6 comprises reciprocating arm 15 connected at one end to flywheel 16 mounted to and extending above axle 6. The other end of arm 15 is bolted to bars 17 and 18 at one of their ends. Bars 17 and 18 are then pivotedly bolted at the other ends to opposite sides of base plate 8. Pivotedly attached to the middle section of bars 17 and 18 are arms 19 and 20 which are rotatably bolted at their other ends to shingle remover plate 7.

To effect an upper thrust by plate 7 as it moves forward, each skirt 14 is provided with a straght slot 21 and an upwardly curved slot 22. Slots 21 are aligned with the rear edge of plate 7 and slots 22 are located toward the front end of skirt 14 as shown.

Perpendicularly attached to plate 7 and parallel to skirt 14 are bracing plates 23. Each bracing plate 23 is provided with an L-shaped end member 24 attached at its end as shown in FIG. 3. End member 24, bracing plate 23 and skirt 14 are provided with aligned openings through which bolt 25 can pass to secure the end member, bracing plate and skirt together. Second aligned openings in bracing plate 23 and skirt 14 are provided through which plate pushing rod 26 can pass and be secured by cotter pins 27 as shown. In a preferred embodiment, wall guides 28 are perpendicularly attached to the perimeter of curved slots 22 to help guide rod 26 in its movement in slots 22.

Figure 2:
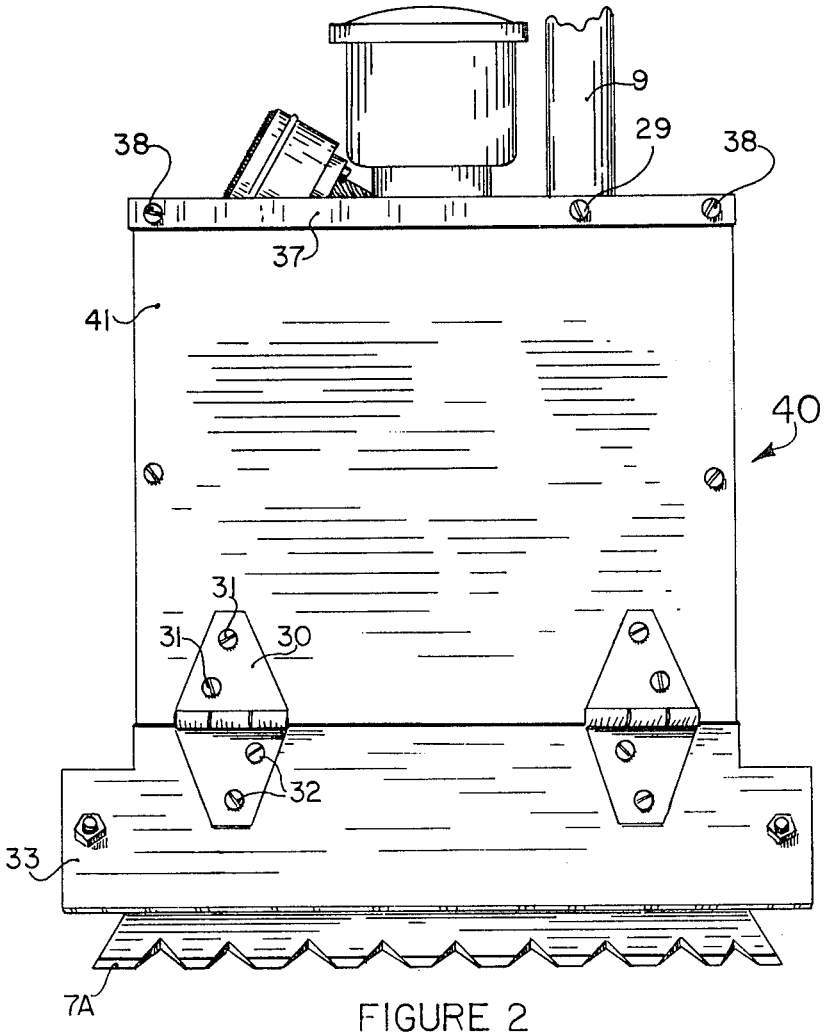
FIG. 2 is a three dimensional top view of a preferred embodiment of the invention.

In another preferred embodiment, shingle shield assembly 40 (see FIG. 2) is provided to keep the loosened and removed roof shingles from fouling the operating of the roof shingle remover. Assembly 40 comprises a shield 41 having a surface that extends the width of plate 4 and attaches at one end by bolt 29 to lifting bar 9 and at its other end to hinge 30 by bolts 31. Attached to hinge 30 by bolts 32 is metal extension piece 33, which is forced down in contact with plate 7 by springs 34 attached at each end to ring bolts 35 and 36, respectively. Extension piece 33 preferably has a limited depth so as not to cover finger members 7A. In another preferred embodiment, shield 41 is constructed of a fabric material to reduce the weight of the shingle remover. In this embodiment, a fabric 41 is attached by bolts 38 to metal bar 37 at the top of fabric 41 to give it the necessary shape and to attach to lifting bar 9.

In operation, the rotation of flywheel 16 causes arms 19 to move back and forth. This reciprocal motion forces plate 7 to move both reciprocately and in an arcuate manner prescribed by curved slot 22. This causes finger members 7A to get underneath the roof shingles and lift them upward, resulting in their removal.

There are, of course, many alternate obvious embodiments not specifically disclosed but which are intended to be included within the scope of this invention as defined by the following claims.

What I claim is:

1. A roof shingle remover comprising:

(a) a power source mounted on a frame, said power source attached to one end of a drive means to impart a reciprocal motion thereto, said drive means connected at its other end to a shingle remover plate, (b) parallel guide plates attached to said frame and extending on opposite sides of said shingle remover plate, said guide plates having aligned slots, and (c) a plate pushing rod extending through said slots and attached to said shingle remover plate, said slots being positioned in said guide plates and having a sufficiently arched forward end portion to impart an upward thrust by said shingle remover plate during its forward motion.

2. A roof shingle remover comprising:

(a) a power source mounted on a frame provided with wheels rotatably attached to said frame, (b) a drive means connected at one end to a flywheel attached to a rotating shaft of said power source to provide reciprocal motion to said drive means and said drive means connected at its other end to a shingle remover plate, (c) parallel guide plates attached to said frame and extending on opposite sides of said shingle remover plate, said guide plates having aligned slots which are upwardly curved at the forward end portion of said guide plates, (d) a plate pushing rod extending through said slots and attached to said shingle remover plate, (e) a roof shingle shield attached to said frame and extending over said guide plates, and (f) an extension plate hingedly attached to said roof shingle shield and positioned in contact with said shingle remover plate by springs attached at one end to said extension plate and at their opposite ends attached to said guide plates and wherein said extension plate has sufficiently short depth to contact said shingle remover plate.

* * * * *